US006033524A

United States Patent [19]

Pruszynski et al.

[11] Patent Number: 6,033,524

[45] Date of Patent: Mar. 7, 2000

[54] SELECTIVE RETENTION OF FILLING COMPONENTS AND IMPROVED CONTROL OF SHEET PROPERTIES BY ENHANCING ADDITIVE PRETREATMENT

[75] Inventors: Przemyslaw Pruszynski; Regina Jakubowski; John R. Armstrong, all of Ontario, Canada; Scott W. Rosencrance, Naperville, Ill.

[73] Assignee: Nalco Chemical Company, Naperville, Ill.

[21] Appl. No.: 08/977,512

[22] Filed: Nov. 24, 1997

[51] Int. Cl.[7] ..... D21H 17/48; D21H 21/10

[52] U.S. Cl. ..... 162/165; 162/164.1; 162/164.6; 162/168.3; 162/169; 162/158; 162/181.1; 162/181.7; 162/181.8; 162/183

[58] Field of Search ..... 162/164.1, 164.6, 162/165, 166, 168.1, 168.2, 168.3, 168.7, 169, 158, 175, 181.1, 181.2, 181.7, 181.8, 183

[56] References Cited

U.S. PATENT DOCUMENTS

| | | | |
|---|---|---|---|
| 3,141,815 | 7/1964 | Manley | 162/164.3 |
| 4,070,236 | 1/1978 | Carrard et al. | 162/164.5 |
| 4,272,297 | 6/1981 | Brooks et al. . | |
| 4,295,933 | 10/1981 | Smith . | |
| 4,313,790 | 2/1982 | Pelton et al. | 162/163 |
| 4,388,150 | 6/1983 | Sunden et al. . | |
| 4,495,245 | 1/1985 | Zunker . | |
| 4,913,775 | 4/1990 | Langley et al. . | |
| 4,943,349 | 7/1990 | Gomez . | |
| 5,244,542 | 9/1993 | Bown et al. . | |
| 5,670,021 | 9/1997 | Owens . | |

FOREIGN PATENT DOCUMENTS

| | | |
|---|---|---|
| 0 773 319 A1 | of 0000 | European Pat. Off. . |
| 0 621 369 A1 | 10/1994 | European Pat. Off. . |
| 67735 | 1/1985 | Finland . |
| 2001088 | of 0000 | United Kingdom . |
| WO 86/04370 | of 0000 | WIPO . |
| WO 94/17243 | of 0000 | WIPO . |
| WO 95/21295 | 8/1995 | WIPO . |

OTHER PUBLICATIONS

Leung et al. "Flocculation of paper fines by polyethyleneoxide", Tappi Journal, vol. 70, No. 7, pp. 115–118, Jul. 1987.

Pelton et al., "Novel dual–polymer retention aids for newsprint and groundwood specialties", Tappi Journal, vol. 64, No. 11, pp. 89–92, Nov. 1981.

Braun et al., "Filler and fiber retention in newsprint and groundwood specialties using poly(ethylen–oxide)", Tappi Journal, vol. 67, No. 9, pp. 110–114, Sep. 1984.

Tay, "Application of polymeric flocculant in newsprint stock system for fines retention improvement", Tappi Journal, vol. 63, No. 6, pp. 63–66, Jun. 1980.

Wegner, "The effects of polymeric additive on papermaking", Tappi Journal, vol. 70, No. 7, pp. 107–111, Jul. 1987.

Pelton et al., "A survey of potential retention aids for newsprint manufacture", Pulp & Paper, vol. 81, No. 1, pp. 54–62, Jan. 1980.

*Primary Examiner*—Jose Fortuna

*Attorney, Agent, or Firm*—Margaret M. Brumm; Thomas M. Breininger

[57] ABSTRACT

A method for increasing retention and drainage of filling components in a paper making furnish in a paper making process comprising the steps of: making a slurry of filling components, treating the slurry with from about 0.003% to about 2.0% by weight based on total solids of a phenolic enhancer to form a pretreated filling components slurry, adding to the furnish the pretreated slurry and adding to the furnish from about 0.003 to about 0.5% by weight based on total solids in the slurry of a polymeric flocculent, whereby retention and drainage of filling components in the paper making furnish is increased. A preferred enhancer is a condensate of phenol and formaldehyde and preferred flocculants contain acrylamide, methacrylamide, and/or N-vinylformamide. The method provide important benefits in many papermaking applications, in which desirable filling components are retained in the final sheet, while undesirable filling components, such as ink and dye particles present in a recycled papermaking furnish, are not retained.

18 Claims, No Drawings

SELECTIVE RETENTION OF FILLING COMPONENTS AND IMPROVED CONTROL OF SHEET PROPERTIES BY ENHANCING ADDITIVE PRETREATMENT

FIELD OF THE INVENTION

The present invention is in the technical field of paper making and more particularly in the technical field of wet-end additives to paper making furnish.

BACKGROUND OF THE INVENTION

In the manufacture of paper, an aqueous cellulosic suspension containing cellulose fiber and selected mineral pigments is formed into a paper sheet. The cellulosic slurry is generally diluted to a consistency (percent dry weight of solids in the slurry) of less than 1%, and often below 0.5% ahead of the paper machine. Associated with papermaking slurries, called furnishes, is a large variation in the size and shape of the particles present. These particles may range in size from less than one micrometer for many mineral pigments or fillers, up to several millimeters in their largest dimension for fibers. The initial dewatering of a paper furnish typically takes place by the ejection of the cellulosic furnish onto or between filter fabric(s), called the wire. The openings in these wires are typically on the order of 200 mesh, which corresponds to a hole size capable of passing particles with a diameter of 76 micrometers. If no forces of attraction exist between particles, the mineral pigments would very easily pass through the wire and would not be retained in the sheet, compromising the benefits for which the mineral pigments were added. Thus, under normal papermaking circumstances, many components of the furnish that are small enough to pass through the openings in the wire will require modification if they are to remain in the sheet.

As the fibers form a mat on the wire, they generate their own filter medium and many of the smaller particles in the furnish may be trapped by simple filtration in the fiber mat, particularly if the sheet is thick, i.e. high basis weight. However, even if the basis weight is high, a significant fraction of the small particulate material may not be adequately retained. When basis weights are low or machine turbulence prevents mat formation, the filtration mechanism of small particle retention is severely inadequate. Under papermaking circumstances when the filtration mechanism is inadequate, chemical treatments generally called retention aids are required to modify the interparticle interactions thereby resulting in coagulation and/or flocculation of the particles.

Retention of small particulate components leads to numerous benefits for the papermaker. Mineral fillers like clay and calcium carbonate are often less expensive than fibers, and substitution of such fillers for fiber provides a way for the papermaker to reduce the raw material costs. Retention of fillers and fiber fines is also necessary to achieve the sheet properties needed for a given end use. Such properties might include sheet opacity, brightness, and appropriate ink interactions. Because the small particles have large surface areas for a given mass, significant amounts of additives such as dyes or sizing agents can be attached to them making retention of the fines necessary for effective utilization of such additives.

Filler particles and fiber fines which are not retained initially, or in the so called first pass, are to a large extent recycled via the white water system back into the furnish, increasing the fraction of small particles present in the furnish over time. This result is often unsatisfactory for several reasons. Some important and expensive materials lose their effectiveness upon recycling in the white water system, and their retention in the first pass is needed for performance or sheet properties. Examples of such materials are titanium dioxide and alkaline sizing agents. Although the total amount of fines in the sheet may be increased in this way, their distribution in the sheet will tend to be very uneven frequently resulting in two-sided phenomena of the paper. In addition, the concentration of unretained materials in a papermachine's white water system can contribute to deposit problems and related runnability problems which result in lost or slowed production and poor product quality. These problems are remedied by using effective retention aids, resulting in a cleaner machine with improved runnability, more efficient use of fiber and filler raw materials, and less waste to the mill's waste treatment facility.

Typical retention aids include polymeric coagulants, which are cationic solution polymers of low to medium molecular weight ($10^3$–$10^6$ g/mole). Because these are polymers with high cationic charge densities, their activity in attention applications is believed to derive from their interactions with negatively charged papermaking components. Because of the shear sensitivity and relatively small floc sizes often formed with polymeric coagulants, they are seldom used alone as retention aids, but are used in conjunction with a flocculant as a dual polymer program. In this way, the coagulant is thought to provide an initial agglomeration of particles which can be more effectively flocculated.

Similarly, hydrolyzable aluminum salts are used extensively as coagulants in papermaking. Because of the acid generated by the aluminum hydrolysis, the pH of machines using alum is depressed, and the process is referred to as "acid papermaking". The aluminum species possessing the greatest coagulating ability are formed in the pH range of 4 to 6. Polyaluminum chlorides are also effective coagulants. Being partially neutralized, they do not depress the pH to the extent that alum does and are generally more applicable over a wider pH range.

Flocculation describes a number of possible strategies which result in agglomeration of small particles. Different degrees of flocculation are required at each stage of operation in pulp and paper mills. At the forming wire on the paper machine, paper is formed by the rapid dewatering of the furnish. Retention aids operate by flocculating of the components of the slurry before the slurry is consolidated as the sheet in the consecutive dewatering stages. A proper level of flocculation is necessary to provide the required retention and drainage rate.

In a single polymer program, a flocculant, typically a cationic polymer, is the only material added. The flocculent is added to the thin stock after the cellulosic and filling streams have been mixed. Another method of improving the flocculation of cellulosic fines, mineral fillers and other furnish components on the fiber mat is the dual polymer program, also referred to as a coagulant/flocculant system, added ahead of the paper machine. In such a system there is first added a coagulant, for instance a low molecular weight synthetic cationic polymer or cationic starch, to the furnish typically after mixing of the cellulosic and filling streams, for initial agglomeration of such particles, followed by the addition of a flocculent. The flocculant generally is a high molecular weight synthetic polymer. The presence of these large agglomerates in the furnish as the fiber mat of the paper sheet is being formed increases retention. The agglomerates are filtered out of the water onto the fiber mat, whereas unagglomerated particles would to a great extent pass through.

In systems containing high concentrations of anionic polymeric/oligomeric substances, the performance of cationic polymers is often detrimentally affected. These anionic substances may be of inorganic or organic origin. Silicates used as hydrogen peroxide stabilizers in pulping, bleaching, and de-inking processes and species extracted from the wood like polygalacturonic acids and lignin derivatives are the most typical examples of components of anionic detrimental substances, also called "anionic trash". Nonionic polymers are affected by these substances to a much lower degree than cationic polymers.

An example of a nonionic polymer system is the polyethylene oxide (PEO) and cofactor program. This system is often an effective retention aid for newsprint and other mechanical pulp furnishes. Known cofactors include kraft lignin, sulfonated kraft lignin, naphthalene sulfonate, tannin extract, and phenol-formaldehyde resins. A recent EPO patent application (Echt, EPO Application No. 621 369 A1, 1995), discloses using poly(p-vinyl phenol) as a cofactor. Moreover, phenol sulphone formaldehyde resins are described in WO 95/21295 to improve retention. However, these resins are added after a cationic polymer is incorporated into the cellulosic suspension.

Another approach using nonionic polymers in tandem with a cofactor include that of Huinig Xiao and R. Pelton. Xiao reported synthesis of a copolymer of acrylamide and poly(ethylene-glycol) methacrylate. This copolymer contains pendant PEG chains which, as claimed by Xiao and Pelton, are able to interact with resole-type phenolic resin to form the three dimensional structures responsible for its good performance as a retention polymer. However, Xiao and Pelton did not report any beneficial effect from the use of phenolic resin on flocculation performance of polyacrylamide homopolymers. This information is summarized in WO 94/17243 application. Unexpectedly, a synergism was found between homopolymer acrylamide and certain cofactors such as a phenol formaldehyde resin under the appropriate conditions. The strategy is discussed in EPO Publication No. EP 0 773 319 A1.

There is growing interest in increasing the filler content of paper, due to both raw material costs and energy savings, as filled papers require less refining and are easier to dewater than unfilled papers. As used herein, the term fillers includes calcium carbonates, clay in various forms, talc, titanium dioxide, gypsum, hydrated aluminum oxide, silicas, and plastic pigments among others. In addition, final sheet properties can be enhanced by increased filler loading, such as opacity, brightness, and printability.

Attempts to achieve improved filler retention have focused on modification of the filler surface by chemical pretreatment. Commercial filler material suppliers have chemically modified their filler particles by attaching/associating cationic polymers to the surface to be sold as specialty-grade fillers. In a similar way, chemical vendors have added cationic polymers to the filler slurries on-site at a paper mill to induce filler preagglomeration prior to the filler slurry being mixed with the fiber slurry. Such filler pre-agglomeration has been disclosed in PCT Application No. WO 86/04370; U.S. Pat. Nos. 4,295,933 and 4,272,297 and in British Patent No. 2,001,088.

Modified filler formation by treating a filler first with an aqueous colloidal dispersion of cationic melamine-formaldehyde resin followed by treatment with aqueous vinyl alcohol polymer solution is described in U.S. Pat. No. 4,495,245. Surface treatment of cationic fillers with a dispersing agent which is a cationic polyelectrolyte to render the particles cationic is described in U.S. Pat. No. 5,244,542. Enhanced retention is obtained by flocculating beforehand a mineral filler and a binder (such as a starch or synthetic polymer) prior to incorporation into a fiber suspension in U.S. Pat. No. 4,943,349. In these ways, increases in filler retention in the final product have been observed.

U.S. Pat. No. 4,913,775 provides a general overview of modes of addition of treatment agents for the production of paper and paper board. FI 67735 describes a process in which retention is improved by the addition of a cationic polymer and an anionic component which may be pre-mixed; however, that reference states that such an addition procedure does not yield optimum results. U.S. Pat. No. 4,388,150 describes starch and colloidal silicic acid which may be pre-mixed and then added to stock. This reference also states that such a procedure does not provide maximized results.

U.S. Pat. No. 5,670,021 describes a process for papermaking wherein a mixture of an alkali silicate and a phenolformaldehyde resin optionally are added to the filler before addition to the cellulosic slurry. The system is then treated with PEO as the flocculant, to improve retention, drainage and formation in the papermaking process.

The use of nonionic programs involving PEO have several quite significant liabilities. The high molecular weight PEO used for wet end applications is typically a dry polymer which requires an extremely costly and tedious makedown system. If the PEO is not properly prepared the performance of the polymer dramatically suffers not to mention the potential for detrimentally impacting runnability due to particulate residuals in the polymer feed. PEO is known to be chemically sensitive to residual oxidizers and some metal ions which are commonly present on the wet end of papermachines. This molecular weight degradation can result in sporadic, unstable, performance. The performance of the PEO containing programs are known to be very shear sensitive. This sensitivity potentially hinders performance on shear intensive large modern papermachines. Finally, because of the raw materials and processing involved, PEO is quite expensive relative to many other water-soluble polymers.

The present invention departs dramatically from any previous disclosures of improved filler retention based on the chemical pretreatment of filler particles. As defined herein the term filler components includes, but is not limited to conventional fillers as described above, and is meant to encompass small filling and property-modifying solids. The present invention describes the novel application of a dual polymer program for the process of papermaking wherein the flocculant is composed of monomers from a select group. Furthermore, this novel application allows the papermaker selective retention of filling materials relative to other components present in the papermaking slurry. This application strategy does not necessarily need to yield an improvement in overall retention to offer the benefits of improved runnability and sheet properties. This application is designed to preferentially retain certain characteristic fractions of the furnish, in this case fillers. These fillers can be retained preferentially over cellulosic materials or in some cases preferentially with respect to brightness degrading ink particles.

The present invention departs dramatically from previous disclosures of improved filler retention based on the chemical pretreatment of filler particles. This disclosure teaches an improvement to papermaking by pretreating filling materials as opposed to the conventional method of preflocculation of filling materials. Specifically, this invention teaches the use of phenolic additives (enhancers) to pretreat fillers prior to introduction of the filler stream into the cellulosic papermaking slurry for improved retention of filling components and runnability. This addition can occur with or without a pH adjustment using common hydrogen atom donors such as dilute mineral acids although the resulting performance is often significantly increased for the flocculants disclosed in this invention if the pH of the filling slurry is adjusted to about 5. In addition, this invention teaches the ability to maintain the observed benefits even in the 5 presence of high levels of anionic detrimental substances.

In the first step of this invention, a phenolic enhancer material is added to the filling components of choice before the filler slurry is mixed with the fiber slurry, with the phenolic enhancer material either being mixed with the filler slurry, stored for a given amount of time, and fed separately as a product, or with the phenolic enhancer material being mixed with the filler slurry on-site at a paper mill just prior to adding the filler slurry to the fiber slurry. This addition can occur with or without a pH adjustment using common hydrogen atom donors such as dilute mineral acids. In a subsequent step in this invention, a flocculant is added to the furnish that contains the pretreated filler stream resulting in a significantly selective increase in retention of filler relative to other low brightness particles in the final sheet of paper produced. This interaction also leads to improvement in retention, drainage, formation and in general runnability of the papermaking process. Thus, this invention teaches a new application that offers improved levels of retention, formation, uniform porosity, and overall dewatering as well as selective retention of filling solids relative to other particulate materials in the system.

SUMMARY OF THE INVENTION

A method for increasing retention and drainage of filling components in a paper making furnish in a paper making process comprising the steps of: making a slurry of filling components, treating the slurry with from about 0.003% to about 2.0% by weight based on solids of a phenolic enhancer to form a pretreated filling components slurry, and adding from about 0.003 to about 0.5% by weight based on total solids in the slurry of a polymeric flocculant either before or after the filling material is introduced into the furnish, whereby retention and drainage of filling components in the paper making furnish is increased. A preferred enhancer is a condensate of phenol and formaldehyde and preferred flocculants are homopolymers or copolymers of acrylamide.

The methods provide important benefits in many papermaking applications, in which desirable filling components are retained in the final sheet, while undesirable components, such as ink and dye particles present in a papermaking furnish, are not retained.

DESCRIPTION OF THE INVENTION

One aspect of this invention is a method for increasing retention and drainage of filling components in a paper making furnish in a paper making process comprising the steps of:

a) making a slurry of filling components;

b) treating said slurry with from about 0.003 to about 2.0% by weight based on total solids of a phenolic enhancer to form a pretreated filling components slurry;

c) adding to said furnish said pretreated slurry of step b); and then, d) adding to said furnish from about 0.003 to about 0.5% by weight based on total solids in the slurry of a polymeric flocculent, whereby retention and drainage of said filling components in said paper making furnish is increased.

Yet another aspect of this invention is a method for increasing retention and drainage of filling components in a paper making furnish in a paper making process comprising the steps of:

a) making a slurry of filling components;

b) treating said slurry with from about 0.003 to about 2.0% by weight based on total solids of a phenolic enhancer to form a pretreated filling components slurry;

c) adding to said furnish from about 0.003 to about 0.5% by weight based on total solids in the slurry of a polymeric flocculent and then, d) adding to said furnish said pretreated slurry of step b);

whereby retention and drainage of said filling components in said paper making furnish is increased.

The following descriptive paragraphs apply to any aspect of the invention described above. Filling components may be selected from the group consisting of: calcium carbonates, clay, silica, titanium dioxide, magnesium oxide, gypsum, talc, hydrated aluminum oxide, magnesium silicate and mixtures thereof. The phenolic enhancer may be selected from the group consisting of phenol-formaldehyde resins, tannin extracts, naphthol-formaldehyde condensates, poly(para-vinyl phenol), as well as substituted versions of these enhancer materials where the substituted functionality includes but is not limited to moieties such as carboxylates, sulfonates, and phosphonates, and mixtures thereof. Tannin extracts as utilized herein refers to naturally occurring polyphenolic substances that are present in the organic extracts of bark of some wood species.

pH conditions of step a) may be from about 4 to about 8, though preferably, pH conditions of step a) are from about 4.5 to about 6.5. From about 0.007 to about 1.0% by weight based on total solids in the furnish of the phenolic enhancer may be added in step b). Preferably, from about 0.02 to about 0.5% by weight based on total solids in the furnish of the phenolic enhancer may be added in step b).

The papermaking furnish may be selected from, but is not limited to, the group consisting of fine paper, board, and newsprint paper making furnishes.

The flocculant may be a nonionic, anionic, or cationic polymer. Moreover, the flocculent may have a molecular weight of at least about 500,000. Preferably, the flocculant has a molecular weight of at least about 1,000,000. Most preferably, the flocculent has a molecular weight of at least about 5,000,000.

Any of the methods may further comprise adding a cationic coagulant to said furnish at a dosage of preferably from about 0.001 to about 1% by weight based on total solids in the slurry; or the addition of a process aid selected from a group consisting of but not limited to: bentonite, talc, silica, cationic starch and mixtures thereof.

The present invention demonstrates improved retention of filling components, such as clay, silica, titanium dioxide, magnesium oxide, ground calcium carbonate, pulverized calcium carbonate, inorganic pigments, organic pigments, or any other such small filling and property modifying solids that has been pretreated with a synthetic or natural polymer containing, for example, phenolic or naphtholic groups as well as sulphonated phenolic or naphtholic groups, known as enhancers, phenolic material can significantly improve filler retention in conjunction with selected flocculants. The term flocculent used herein includes, but is not limited to, acrylamide homopolymers, copolymers, and terpolymers, methacrylamide homopolymers, copolymers, and terpolymers as well as N-vinylamide homopolymers, copolymers, and terpolymers.

This invention is a method for increasing the retention and drainage of filling components of a paper making furnish in a paper making system which comprises the steps of adding to a slurry of filling components from about 0.003 to about 2.0% (as actives) of a phenolic enhancer material by weight based on total solids in the furnish, the addition of phenolic enhancer material to the slurry of filling components either occurring on-site at a paper mill or in a previous location for the purpose of creating as a product a filling component. A flocculant is added to the furnish containing said pretreated filling components in the amount of from about 0.001 to about 0.5% (as flocculent actives) by weight based on total solids in the final furnish.

It is not necessary that all filler to be introduced into the papermaking slurry be pretreated. A portion of the filler can be pretreated with the enhancer material, then mixed with the untreated filler prior to being introduced into the cellulosic material containing slurry. Furthermore, the pretreated filler stream could be split and partially added at different locations in the papermaking process. Specifically, a portion of the pretreated filling material can be added either before or after the flocculent is introduced. A portion of the pretreated filling material can be added before or after high shear zones such as fan pumps and pressure screens.

The dosage of the phenolic enhancer material is preferably from about 0.003 to about 2.0% by weight based on total solids in the slurry, more preferably from about 0.007 to about 1.0% and most preferably from about 0.02 to about 0.5%.

Typically, the pretreatment of the filler material with the enhancer will include a dwell time of seconds and a reasonable mixing such as that associated with an in line dilution or static mixer. It is important to note that both the time of contact between enhancer and filler and the mixing intensity are variable. A pH adjustment step during the pretreatment often improves performance. The necessity of this adjustment will be dictated by the observed performance. If the adjustment is necessary, to the most beneficial pH of about 5, this is accomplished by using a dilute solution of a proton donor such as a mineral acid.

The flocculants used in the application of this invention are generally selected from, however, not limited to, the following three classes: nonionic, anionic and cationic. The nonionic flocculants in these examples are homopolymers or copolymers or terpolymers and so on of nonionic monomers. The preferred nonionic monomers are acrylamide or methacrylamide or N-vinylformamide and preferred nonionic flocculants are poly(acrylamide) and poly (methacrylamide) and poly(N-vinylformamide), respectively.

The dosage of nonionic flocculants of acrylamide, methacrylamide and/or N-vinylamide polymeric flocculant is preferably from about 0.001 to about 0.5% (as actives) by weight based on total solids in the slurry, more preferably from about 0.003 to about 0.2% and most preferably from about 0.007 to about 0.1%.

The nonionic flocculants useful in the practicing of this invention can be formed from at least one of the monomers chosen from the group consisting of acrylamide, methacrylamide, N-tertiary butyl acrylamide, N-vinylformamide, N-vinylpyrrolidone, N-vinylpiperidone, N-vinylcaprolactam, N-vinyl-3-methylpyrrolidone, N-vinyl-5 -methylpyrrolidone, N-vinyl-5-phenylpyrrolidone, N-vinyl-2-oxazolidone, N-vinylimidazole, vinylacetate, maleimide, and N-vinylmorpholinone among others. The monomers thus described may be polymerized to form homopolymers. When polymerized in combination, copolymers or terpolymers may result.

A cationic or an anionic acrylamide or N-vinylamide copolymer or terpolymer flocculant may be used in place of the nonionic acrylamide or N-vinylamide polymer flocculant. In some cases, such as when an anionic acrylamide or N-vinylamide copolymer or terpolymer flocculant is used, a cationic coagulant must be added to the slurry before the flocculant is added. The dosage of coagulant is preferably from about 0.001 to about 1% by weight based on total solids in the slurry, more preferably from about 0.01 to about 0.5% and most preferably from about 0.02 to about 0.25%.

By the term of cationic flocculant, it is understood to include any water-soluble copolymer of (meth)acrylamide which carries or is capable of carrying the cationic charge when dissolved in water, whether or not this charge-carrying capacity is dependent upon pH. The cationic copolymers of (meth)acrylamide include the following examples which are not meant to be limiting on this invention: copolymers of (meth)acrylamide with dimethylaminoethyl methacrylate (DMAEM), dimethylaminoethyl acrylate (DMAEA), diethylaminoethyl acrylate (DEAEA), diethylaminoethyl methacrylate (DEAEM) or their quaternary ammonium forms made with dimethyl sulfate or methyl chloride, Mannich reaction modified polyacrylamides, diallylcyclohexylamine hydrochloride (DACHA HCl), diallyldimethylammonium chloride (DADMAC), methacrylamidopropyltrimethylammonium chloride (MAPTAC) and allyl amine (ALA).

By the term of cationic flocculant, it is also understood to include any water-soluble copolymer of N-vinylformamide or related monomers which carries or is capable of carrying the cationic charge when dissolved in water, whether or not this charge-carrying capacity is dependent upon pH. The cationic copolymers of (meth)acrylamide include the following examples which are not meant to be limiting on this invention: copolymers of (meth)acrylamide with dimethylaminoethyl methacrylate (DMAEM), dimethylaminoethyl acrylate (DMAEA), diethylaminoethyl acrylate (DEAEA), diethylaminoethyl methacrylate (DEAEM) or their quaternary ammonium forms made with dimethyl sulfate or methyl chloride, Mannich reaction modified polyacrylamides, diallylcyclohexylamine hydrochloride (DACHA HCI), diallyldimethylammonium chloride (DADMAC), methacrylamidopropyltrimethylammonium chloride (MAPTAC) and allyl amine (ALA).

The high molecular weight anionic polymers are preferably water-soluble vinyl copolymers of (meth)acrylamide with following monomers: acrylic acid, 2-acrylamido-2-methylpropane sulfonate (AMPS) and mixture thereof. The anionic high molecular weight flocculants may also be either hydrolyzed acrylamide polymers or copolymers of acrylamide or its homologues, such as methacrylamide, with acrylic acid or its homologues, such as methacrylic acid, or with monomers, such as maleic acid, itaconic acid, vinyl sulfonic acid, AMPS, or other sulfonate containing monomers. The anionic polymers may be sulfonate or phosphonate containing polymers which have been synthesized by modifying acrylamide polymers in such a way as to obtain sulfonate or phosphonate substitutions, or mixtures thereof. The most preferred high molecular weight anionic flocculants are acrylic acid/acrylamide copolymers, and sulfonate containing polymers such as 2-acrylamide-2-methylpropane sulfonate/acrylamide copolymer (AMPS), acrylamido methane sulfonate acrylamide (AMS), acrylamido ethane sulfonate/acrylamide (AES) and 2-hydroxy-3-acrylamide propane sulfonate/acrylamide (HAPS).

The high molecular weight anionic polymers are preferably water-soluble vinyl copolymers of N-vinylformamide or related monomers with the following monomers: acrylic acid, 2-acrylamido-2-methylpropane sulfonate (AMPS) and mixture thereof. The anionic high molecular weight flocculants may also be either hydrolyzed acrylamide polymers or copolymers of acrylamide or its homologues, such as methacrylamide, with acrylic acid or its homologues, such as methacrylic acid, or with monomers, such as maleic acid, itaconic acid, vinyl sulfonic acid, AMPS, or other sulfonate containing monomers. The anionic polymers may be sulfonate or phosphonate containing polymers which have been synthesized by modifying acrylamide polymers in such a way as to obtain sulfonate or phosphonate substitutions, or mixtures thereof. The most preferred high molecular weight anionic flocculants are acrylic acid/acrylamide copolymers, and sulfonate containing polymers such as 2-acrylamide-2-methylpropane sulfonate/acrylamide copolymer (AMPS), acrylamido methane sulfonate acrylamide (AMS), acrylamido ethane sulfonate/acrylamide (AES) and 2-hydroxy-3-acrylamide propane sulfonate/acrylamide (HAPS).

It is preferred that nonionic, cationic and anionic flocculants have a molecular weight of at least 500,000. A more preferred molecular weight is at least about 1,000,000 with the best results observed when molecular weight is greater than about 5,000,000. The anionic or cationic monomer may constitute up to about 80 mole % of the copolymer, with best results observed the range of about 0 to about 30 mole % of an anionic or a cationic charge.

High molecular weight flocculants (anionic, nonionic, cationic) may be used in the solid form, as an aqueous solution, as water-in-oil emulsion, or as dispersion in water.

A detrimental substances controlling additive such as bentonite, talc, cationic starch, cationic coagulant, or mixtures thereof may be added anywhere to the system. The preferred addition point is the thick stock pulp before dilution with white water. This application results in increased cleanliness of the paper making operation which otherwise experiences hydrophobic deposition affecting both the productivity and the quality of paper.

Coagulant is typically a cationic polymer having a low molecular weight of at least about 1,000 and less than about 500,000. More preferably, the molecular weights range from about 2,000 to about 200,000.

Examples of polymers used as coagulants include copolymers formed from diallyldimethylammonium chloride and monomers selected from the group consisting of quaternized dimethylaminoethylacrylates, quatemized dimethylaminomethacrylates, vinyltrimethoxysilane, acrylamide, diallyldimethylaminoalkyl(meth)acrylate, diallyldimethylaminoalkyl(meth)acrylamide and mixtures thereof. In addition, polymers that can be used include polyethylene imines, polyamines, polycyanodiamide formaldehydes, poly(diallyldimethylammonium chloride), poly(diallyldimethylaminoalkyl(meth)acrylates), poly (diallyldimethylaminoalkyl(meth)acrylamides, condensation polymers of dimethyl amine and epichlorohydrin as well as copolymers formed from acrylamide and/or diallyldimethylaminoalkyl(meth)acrylates and diallyldimethylaminoalkyl(meth)acrylamides, condensation polymers of ammonia and ethylene dichloride or copolymers formed from acrylamido N,N-dimethyl piperazine quaternary salt and acrylamide.

Polymeric coagulants applicable to this invention may also include poly(vinylamines) such as those formed from at least one monomer selected from the group consisting of amidine vinylformamide, vinyl alcohol, vinyl acetate, vinyl pyrrolidinone, polymerized with the esters, amides, nitriles or salts of (meth)acrylic acid. Additionally, the coagulant may be an inorganic material such as alum. In addition, this invention may be applied to a paper mill slurry selected from the group consisting of fine paper, board, and newsprint paper mill slurries. The slurries include those that are wood-containing, wood-free, virgin, recycled and mixtures thereof. The present process is believed applicable to all grades and types of paper products that contain the filling components described herein.

The phenolic enhancer material is selected from a group consisting of phenol-formaldehyde resins, tannin extracts, naphthol-formaldehyde condensates, poly(para-vinyl phenol), as well as substituted versions of these enhancer materials where the substituted functionality includes but is not limited to moieties such as carboxylates, sulfonates, and phosphonates, and mixtures thereof.

Other additives may be charged to the cellulosic slurry without any substantial interference with the activity of the flocculant/phenolic enhancer material combination of the present invention. Such other additives include for instance sizing agents, such as alum and rosin, microparticles, pitch control agents, and biocides among others.

The amount of any filling components used in the paper making process generally employed in a paper making stock is from about 5 to about 30 parts by weight of the filler per hundred parts by weight of dry pulp in the slurry, but the amount of such filling component may at times be as low as about 1 part by weight, and as high as about 50 parts by weight, on the same basis.

To determine the efficiency of the method described herein, the following Britt Jar experimental procedure was utilized. The Britt Jar test is an industry-approved laboratory evaluation of FPR and FPAR. First Pass Retention (FPR) is a measure of a degree of incorporation of total solids into the formed sheet. It is calculated from the consistency of the paper making slurry $C_s$ and consistency of white water $C_{ww}$ resulting during the sheet formation:

$$FPR=((C_S-CW)/C_S)\times 100\%$$

Therefore, a higher FPR number indicates a more efficient treatment agent.

First Pass Ash retention (FPAR) is a measure of the degree of incorporation of filler into the formed sheet. It is calculated from the filler consistencies in the initial paper making slurry $C_{fs}$ and filler consistency of white water $C_{fww}$ resulting during the sheet formation:

$$FPAR=((C_{fs}-C_{fww})/C_{fs})\times 100\%$$

Therefore, a more efficient treatment would be indicated by a higher FPAR number.

The Britt Jar consists of a baffled container, an impeller, a screen through which drainage occurs (typically 200-70 mesh) and a valve. It is used to duplicate paper machine shear conditions. The experiment was performed by adding a sample of stock (furnish obtained from a midwestern paper mill) having a known consistency to the Britt Jar while the impeller is in operation. The stock was then treated with diluted solutions of the treatment to be evaluated in a sequence which best reflected paper machine addition points. At the end of experiment, a sample of white water (effluent which passed through the filter of the Britt Jar), typically 100 ml, was collected under dynamic conditions. Dynamic conditions during the drainage were utilized to prevent mat formation.

Consistency of the stock used for the experiments was between 0.2 and 0.7%. In this range retention values are found to be independent of stock consistency. Polymers used in all the experiments were diluted to 1% for coagulants and phenolic enhancers, and 0.1% for flocculants. The Britt Jar impeller was operated at 800 revolutions per minute.

The Britt Jar test is used to duplicate paper machine retention aimed at the effect of colloidal factors on retention rather than hydromechanical factors, i.e., attraction or repulsion forces rather than physical entrapment of fines and mechanical entanglement of fibers. Thus measured retention values do not contain the factor related to filtration and represent true chemical retention component.

For each test, the additives were added in the sequence in which they would be added to the stock on the paper machine. All samples received the same amount of time under agitation, whether or not all additives were introduced in a given test. Each test was conducted by placing the stock in the upper chamber (above the screen) and then subjecting the stock to the following sequences as outlined:

0 seconds—stock added
5 seconds—clay (pretreated or not)
10 seconds—phenolic enhancer added for experiments with no pretreatment
15 seconds—flocculant added
20 seconds—sample collected Consistency of white water $C_{ww}$ and filler consistency of white water $C_{fww}$ were then measured after drying and ashing the filter pad. These values were then used to calculate FPR and FPAR.

The following examples are presented to describe preferred embodiments and utilities of the invention and are not meant to limit the invention unless otherwise stated in the claims appended hereto.

EXAMPLE 1

Table I presents data gathered from experiments with newsprint furnish. The furnish was prepared using a thick stock thermomechanical pulp (TMP) sample from a newsprint mill. About 20% Calcined Clay filler available from Engelhard Corporation in Iselin, N.J. was introduced into the furnish. The consistency was adjusted to about 0.5%.

The effect of the addition of a phenolic enhancer was evaluated both when introduced as a pretreatment to the filler prior to filler incorporation into the papermaking slurry and well as not pretreated, in other words introduced as fillers are conventionally applied. The phenolic enhancer was a commercially available phenol formaldehyde resin of the resole type. During the filler pretreatment all enhancer was added to the filler prior to the filler being introduced into the cellulosic containing papermaking slurry. The pH of the filler when prepared in a slurry using tap water was about 7. For the pretreatment studies involving a pH adjustment the pH was lowered to about pH 6 using a dilute solution of mineral acid.

The nonionic flocculant was a latex inverse emulsion homopolymer acrylamide having total solids of 27.2% and an RSV of 30.0 dl/g commercially available from Nalco Chemical Company in Naperville, Ill. The dosage of flocculant is 2kg/t of product. The dosage of the phenolic enhancer, received as a 41.5% solids from Borden Chemical Co. in Sheboygan, Wis. was 2 kg/t of actives with all dosages based on total furnish solids.

Surprisingly, using a homopolymer of acrylamide as the flocculent subsequent to filler pretreatment using the phenolic material improvements in retention are observed (as indicated by higher values for FPR). The increase in retention is clearly more exaggerated in this example if the pH of the filler is adjusted prior to phenolic enhancer pretreatment. Retention measurements were performed using the previously described Britt jar procedure.

TABLE I

Effect of Pretreatment Mode of Application on Calcined Clay Retention with a Nonionic Polyacrylamide as a Flocculant

| | First Pass Retention | First Pass Ash Retention |
|---|---|---|
| No pretreatment | 77.9 | 68.2 |
| Pretreatment | 83.1 | 75.5 |
| Pretreatment with pH change | 87 | 81.8 |

EXAMPLE 2

Table II presents data gathered from experiments with newsprint furnish. The furnish was prepared using a thick stock TMP sample from a newsprint mill. About 20% Water washed Kaolin clay filler from Engelhard Corporation in Iselin, N.J. was introduced into the furnish. The consistency was adjusted to about 0.5%.

The effect of the addition of a phenolic enhancer was evaluated both when introduced as a pretreatment to the filler prior to filler incorporation into the papermaking slurry and well as not pretreated, in other words introduced as fillers are conventionally applied. The phenolic enhancer was a commercially available phenol formaldehyde resin of the resole type. During the filler pretreatment all enhancer was added to the filler prior to the filler being introduced into the cellulosic containing papermaking slurry. The pH of the filler when prepared in a slurry using tap water was about 7. For the pretreatment studies involving a pH adjustment the pH was lowered to about pH 6 using a dilute solution of mineral acid.

The nonionic flocculant was a latex inverse emulsion homopolymer acrylamide having total solids of 27.2% and an RSV of 30.0 dl/g commercially available from Nalco Chemical Company in Naperville, Ill. The dosage of flocculant is 2kg/t of product. The dosage of the phenolic enhancer, received as a 41.5% solids from Borden Chemical Co. in Sheboygan, Wis. was 2 kg/t of actives with all dosages based on total furnish solids.

Use of a homopolymer of acrylamide as the flocculant subsequent to filler pretreatment without pH adjustment of the filler prior to pretreatment displayed no improvement in retention. However, surprisingly the increase in retention is clear in this example if the pH of the filler is adjusted prior to phenolic enhancer pretreatment. Retention measurements were performed using the previously described Britt jar procedure.

TABLE II

Effect of Pretreatment Mode of Application on Water Washed Clay Retention with a Nonionic Polyacrylamide as a Flocculant

| | First Pass Retention | First Pass Ash Retention |
|---|---|---|
| No pretreatment | 68.2 | 55 |
| Pretreatment | 67.6 | 54.6 |
| Pretreatment with pH change | 73.1 | 65.1 |

EXAMPLE 3

Table III presents data gathered from experiments with newsprint furnish. The furnish was prepared using a thick stock TMP sample from a newsprint mill. About 20% of amorphous silica filler available from J. M. Huber in Havre de Grace, Md. was introduced into the furnish. The consistency was adjusted to about 0.5%.

The effect of the addition of a phenolic enhancer was evaluated when introduced as a pretreatment to the filler prior to filler incorporation into the papermaking slurry. The phenolic enhancer was a commercially available phenol formaldehyde resin of the resole type. During the filler pretreatment all enhancer was added to the filler prior to the filler being introduced into the cellulosic containing papermaking slurry. The pH of the filler when prepared in a slurry using tap water was about 7. The pH was lowered to about pH 6 using a dilute solution of mineral acid during the pretreatment process.

The nonionic flocculant was a latex inverse emulsion homopolymer acrylamide having total solids of 27.2% and an RSV of 30.0 dl/g commercially available from Nalco Chemical Company in Naperville, Ill. and the dosage of the phenolic enhancer is presented in the first column of Table III with all dosages based on total furnish solids.

Use of a homopolymer of acrylamide as the flocculant subsequent to filler pretreatment displayed significant increases in retention. Retention measurements were performed using the previously described Britt jar procedure.

TABLE III

Retention Improvement Using Enhancer Pretreatment Application for amorphous silica as Filler and a Nonionic Acrylamide as Flocculant

| Enhancer Pretreatment (kg/t) | First Pass Retention (%) | First Pass Ash Retention (%) |
|---|---|---|
| 0 | 64.5 | 38.7 |
| 0.6 | 65.0 | 44.4 |
| 1.2 | 67.7 | 55.6 |
| 1.8 | 72.5 | 61.4 |
| 3.5 | 76.4 | 75.9 |

Changes can be made in the composition, operation and arrangement of the method of the present invention described herein without departing from the concept and scope of the invention as defined in the following claims

We claim:

1. A method for increasing retention and drainage of filling components in a paper making furnish in a paper making process comprising the steps of:

a) making a slurry of filling components and adjusting the pH of said slurry so that said pH of said slurry is from about 4.5 to about 6.5;

b) treating said slurry with from about 0.003 to about 2.0% by weight based on total solids of a compound selected from the group consisting of phenol-formaldehyde resins, tannin extracts, naphthol-formaldehyde condensates, poly(para-vinyl phenol) and mixtures thereof to form a pretreated filling components slurry;

c) adding to said furnish said pretreated slurry of step b); and then, d) adding to said furnish from about 0.003 to about 0.5% by weight based on total solids in the slurry of a polymeric flocculant, said flocculant having a molecular weight of at least about 500,000, and said flocculant being selected from the group consisting of cationic and anionic polymers;

whereby retention and drainage of said filling components in said paper making furnish is increased.

2. The method of claim 1 wherein said filling components are selected from the group consisting of: calcium carbonates, clay, silica, titanium dioxide, magnesium oxide, gypsum, talc, hydrated aluminum oxide, magnesium silicate and mixtures thereof.

3. The method of claim 1 wherein from about 0.007 to about 1.0% by weight based on total solids in the furnish of the compound selected from the group consisting of phenol-formaldehyde resins, tannin extracts, naphthol-formaldehyde condensates, poly(para-vinyl phenol) and mixtures thereof is added in step b).

4. The method of claim 1 wherein from about 0.02 to about 0.5% by weight based on total solids in the furnish of the compound selected from the group consisting of phenol-formaldehyde resins, tannin extracts, naphthol-formaldehyde condensates, poly(para-vinyl phenol) and mixtures thereof is added in step b).

5. The method of claim 1 wherein the paper making furnish is selected from the group consisting of fine paper, board, and newsprint paper making furnishes.

6. The method of claim 1 wherein said flocculent is a cationic polymer.

7. The method according to claim 1, further comprising adding a cationic coagulant to said furnish at a dosage of from about 0.001 to about 1% by weight based on total solids in the slurry.

8. The method of claim 1, further comprising the addition of a process aid selected from a group consisting of: bentonite, talc, silica, cationic starch and mixtures thereof.

9. The method of claim 1 in which said flocculant is an anionic polymer.

10. A method for increasing retention and drainage of filling components in a paper making furnish in a paper making process comprising the steps of:

a) making a slurry of filling components and adjusting the pH of said slurry so that said pH of said slurry is from about 4.5 to about 6.5;

b) treating said slurry with from about 0.003 to about 2.0% by weight based on total solids of a compound selected from the group consisting of phenol-formaldehyde resins, tannin extracts, naphthol-formaldehyde condensates, poly(para-vinyl phenol) and mixtures thereof to form a pretreated filling components slurry;

c) adding to said furnish from about 0.003 to about 0.5% by weight based on total solids in the slurry of a polymeric flocculant, said flocculant having a molecular weight of at least about 500,000, and said flocculent being selected from the group consisting of cationic and anionic polymers, and then, d) adding to said furnish said pretreated slurry of step b); whereby retention and drainage of said filling components in said paper making furnish is increased.

11. The method of claim 10 wherein said filling components are selected from the group consisting of: calcium carbonates, clay, silica, titanium dioxide, magnesium oxide, gypsum, talc, hydrated aluminum oxide, magnesium silicate and mixtures thereof.

12. The method of claim 10 wherein from about 0.007 to about 1.0% by weight based on total solids in the furnish of the compound selected from the group consisting of phenol-formaldehyde resins, tannin extracts, naphthol-formaldehyde condensates, poly(para-vinyl phenol) and mixtures thereof is added in step b).

13. The method of claim 10 wherein from about 0.02 to about 0.5% by weight based on total solids in the furnish of the compound selected from the group consisting of phenol-formaldehyde resins, tannin extracts, naphthol-formaldehyde condensates, poly(para-vinyl phenol) and mixtures thereof is added in step b).

14. The method of claim 10 wherein the paper making furnish is selected from the group consisting of fine paper, board, and newsprint paper making furnishes.

15. The method of claim 10 wherein said flocculant is a cationic polymer.

16. The method according to claim 10, further comprising adding a cationic coagulant to said furnish at a dosage of from about 0.001 to about 1% by weight based on total solids in the slurry.

17. The method of claim 10, further comprising the addition of a process aid selected from the group consisting of: bentonite, talc, silica, cationic starch and mixtures thereof.

18. The method of claim 10 in which said flocculant is an anionic polymer.

* * * * *